US007984691B2

(12) United States Patent
Swartz et al.

(10) Patent No.: US 7,984,691 B2
(45) Date of Patent: Jul. 26, 2011

(54) METHODS AND APPARATUS FOR PROVIDING A LIQUID COATING FOR AN ORGANIC PHOTOCONDUCTIVE DRUM

(75) Inventors: Edwin H. Swartz, Sanford, NC (US); Roderick Craig Boone, Raleigh, NC (US); John Edward Pickett, Sanford, NC (US); Lawrence Dale Lewis, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 12/559,576

(22) Filed: Sep. 15, 2009

(65) Prior Publication Data

US 2009/0324809 A1 Dec. 31, 2009

Related U.S. Application Data

(63) Continuation of application No. 11/977,364, filed on Oct. 23, 2007, now Pat. No. 7,588,873.

(51) Int. Cl.
*B05C 13/02* (2006.01)

(52) U.S. Cl. ..... 118/500; 269/289 MR; 134/116; 248/309.2

(58) Field of Classification Search ..... 118/500; 134/116; 82/117, 142; 269/43, 289 MR; 144/286.1, 286.5, 287; 248/309.2; 101/248; 198/832, 835, 860.1
See application file for complete search history.

(56) References Cited

U.S. PATENT DOCUMENTS 3,196,776 A * 7/1965 Norton ..... 99/421 P
3,732,757 A * 5/1973 Cottin ..... 82/117
4,302,092 A * 11/1981 Ashton et al. ..... 396/589
7,784,749 B2 * 8/2010 Radermacher ..... 248/161

* cited by examiner

*Primary Examiner* — Laura Edwards

(57) ABSTRACT

A method of cleaning and coating a used organic photoconductive drum is disclosed. Using this method remanufacturers can reliably reuse certain used organic photoconductive drums which could not be reused without this method. The method comprises providing a used organic photoconductive drum, cleaning the surface of the used organic photoconductive drum, applying a new surface layer comprising a non-volatile non-polar dielectric fluid such as a silicone oil with a viscosity of less than 200 cSt at 40 degrees Celsius. The resulting liquid surface on the used organic photoconductive drum provides wear resistance, and improved electrical characteristics allowing the used organic photoconductive drum to be used at least a second time.

16 Claims, 12 Drawing Sheets

METHODS AND APPARATUS FOR PROVIDING A LIQUID COATING FOR AN ORGANIC PHOTOCONDUCTIVE DRUM

The present application is a continuation of allowed U.S. patent application Ser. No. 11/977,364 filed Oct. 23, 2007, now U.S. Pat. No. 7,588,873 which is incorporated by reference herein in its entirety.

BACKGROUND

A number of different companies manufacture imaging devices such as copiers, printers, fax machines, or all in one devices that perform all of these functions. These imaging devices typically use light to illuminate a light sensitive drum which is coated with a material that causes the illuminated area to differentially charge when compared to the un-illuminated areas of the drum. This differential charge forms a latent image on the cylinder or drum. Toner is attracted to this latent image on the surface of the drum, and then is transferred through well known processes to some media such as paper.

The light sensitive drum originally was a selenium coated drum. For cost and environmental reasons the selenium coating has been replaced with a variety of organic chemical materials. The resulting product is known as an organic photoconductive drum. Organic photoconductive drums are used and sold by both the makers of new products, and by companies that repair used products. New organic photoconductive drums may be sold as part of a toner cartridge, as part of a drum cartridge, or as a stand alone replacement unit. These new organic photoconductive drums may be made by the original equipment manufacturers (OEMs) or by different aftermarket companies.

Companies or individuals that repair used products may reuse the existing organic photoconductive drum, or they may replace that organic photoconductive drum with a new aftermarket drum. These companies or individuals who repair used products containing used organic photoconductive drums are sometimes known as remanufacturers. It is obviously more expensive for a remanufacturer to replace an organic photoconductive drum than it is to reuse the old one. However, used organic photoconductive drums are often unusable. The surface is worn during use because abrasive toners rub against the surface, a wiper or cleaner blade presses against the surface of the used organic photoconductive drum as it cleans un-consumed toner from the surface of the organic photoconductive drum, and a primary charge roller rolls against the surface of the organic photoconductive drum during the initial cycle. In some cartridges a developer roller may also contact the surface of the organic photoconductive drum. As a result a used organic photoconductive drum often exhibits gouges, cracks or crazing in the surface layer of the organic photoconductive drum. These wear defects may show up as print defects if the drum is reused. Even if the wear defects are not visible many remanufacturers are unwilling to take the risk of re-using a used organic photoconductive drum because the wear defects could appear in the middle of the next cycle of the organic photoconductive drum.

A number of companies offer products that purport to allow used organic photoconductive drums to be re-used. These substances include powdered PTFE that are applied with a solvent that evaporates. One such product is Slide Coat offered by Anakenesis Technologies, Inc. There are two difficulties with this product. First, it does not work well as the lubricating material appears to be cleaned off of the drum during the second cycle by the wiper blade. Second, powdered PTFE is a hazardous material, which if inhaled can cause flu like symptoms. Another powder based coating is Methuselah powder; a mica based product referenced in U.S. Pat. No. 5,308,515. While the mica based Methuselah power is non-hazardous, and is lubricious, it does not restore the electrical characteristics of the used photoconductive drum. In addition, as will all the powders it is subject to being cleaned off of the surface of the organic photoconductive drum by the wiper blade. Other products on the market place a new solid resin coating on the surface of the used organic photoconductive drum. One example of a polymer resin is QuiCoat offered by LPS Technologies. QuiCoat is a heat cured resin material. These recoating resins do not perform well in a remanufacturing setting. They protect the surface of the used organic photoconductive drum from additional wear, but are difficult to evenly apply frequently putting the organic photoconductive drum slightly out of round due to sag in the resin during the cure. In addition, these resin coatings are typically too resistive, and change the electrical characteristics of the used organic photoconductive drum in unfavorable ways.

SUMMARY

The invention involves a method of recoating an organic photoconductive drum including providing a used organic photoconductive drum, the used organic photoconductive drum having been previously used in an electro photographic process, said electro photographic process using dry toner, the used organic photoconductive drum having a first surface, the used organic photoconductive drum comprising a conductive substrate, a charge generation layer disposed between said conductive substrate and the first surface of said used organic photoconductive drums, a charge transport layer being disposed between said charge generation layer and said first surface. The first surface of said organic photoconductive drum is cleaned, preferably using a cloth. A dielectric non-polar liquid having a viscosity less than 200 cSt at 40 degrees Celsius, and a surface energy less than a surface energy of the first surface of said used organic photoconductive drum should be used for the coating method. The dielectric non-polar liquid is applied to the first surface of the used organic photoconductive drum to form a second surface on the used organic photoconductive drum comprising a layer of said dielectric non-polar liquid. The cleaning and coating of the used organic photoconductive drum may be combined. A cloth impregnated with the dielectric non-polar liquid is placed against the first surface of the used organic photoconductive drum to remove excess debris including toner from that surface and coat the surface.

The coating restores the appropriate electrical characteristics of the organic photoconductive drum and restores lubricity to the surface of the used organic photoconductive drum. Because the coating is a liquid, when areas of the coating are abraded during use, the coating can heal itself as the liquid reflows over the areas that were abraded. The coating is at least durable enough to allow the used organic photoconductive drum to be used in a second cycle.

The present invention is directed to a method of coating a used organic photoconductive drum that was previously used in an electro photographic process (the first cycle) so as to insure that the organic photoconductive drum may be used at least through a second cycle. The organic photoconductive drum is one that has been previously used in an electro photographic process using dry toners such as used organic photoconductive drums in laser printer cartridges, copiers fax machines and the like. The organic photoconductive drum has a conductive substrate, typically made of aluminum, and at least two layers of organic resins a charge transport layer, and a charge generation layer lying between the charge transport layer and the conductive substrate. There may be other layers as well. Common additionally layers include a blocking layer, or an anodizing layer between the conductive substrate and the charge generation layer and surface wear layers. The surface layer of the organic photoconductive drum may be the charge transport layer, or there may be additional layers protecting the surface. With the exception of the anodized layer (if present) the other layers are typically hard plastic resin layers with various additives directed to the layers performance.

In order to coat the used organic photoconductive drum the surface of the organic photoconductive drum must first be cleaned. The surface may be cleaned simply by blowing off the existing toner, paper dust or worn surface particles. Preferably dry compressed filtered air is used to blow off any particles on the surface. More preferably still, a cloth containing a dielectric non-polar liquid with a viscosity of less than 200 CentiStokes (cSt) and a surface energy of less than the surface energy of the surface of the used organic photoconductive drum is used to remove the toner and any other particles from the surface of the used organic photoconductive drum. This method is preferred because it combines the cleaning of the surface of the used organic photoconductive drum with the coating of the surface of the used organic photoconductive drum described next. The cleaned organic photoconductive drum is then coated with a dielectric non-polar liquid with a viscosity of less than 200 Centistokes measured at 40 degrees Celsius. The dielectric non-polar liquid has a surface energy less than that of the surface of the used organic photoconductive drum. This difference in surface energy allows the dielectric non-polar liquid to penetrate any gouges, pores or irregularities in the surface of the used organic photoconductive drum. The difference in surface energy also means that the dielectric non-polar liquid will adhere to surface of the used organic photoconductive drum. The dielectric non-polar liquid may be applied in any number of ways, including soaking a cloth in the liquid and rubbing the cloth against the surface of the used organic photoconductive drum. After the surface of the used organic photoconductive drum is coated with a layer of dielectric non-polar liquid, any excess dielectric non-polar liquid may be removed, preferably with a dry lint free cloth leaving a thin layer of the dielectric non-polar liquid on the surface of the used organic photoconductive drum. In the preferred embodiment, the dielectric non-polar liquid is given time to penetrate any pores gouges cracks or crevices in the surface of the used organic photoconductive drum before any excess dielectric non-polar liquid is removed. The resulting surface layer provides better electrical characteristics to the used organic photoconductive drum, and provides a durable wear layer that remains with the used organic photoconductive drum during the reuse of the used organic photoconductive drum. A used organic photoconductive drum with a dielectric liquid surface layer allows remanufacturers and other entities that repair electro photographic devices to save the expense of purchasing a new organic photoconductive drum when remanufacturing laser toner or drum cartridges.

DETAILED DESCRIPTION

New organic photoconductive drums may be sold by original equipment manufacturers (OEMs) in a frame or cartridge containing many other components including toner, developer rollers, primary charge rollers and the like, or they may be sold separately either by an OEM (as is more common in the copier industry) or by an aftermarket organic photoconductive drum manufacturer as a replacement part for an OEM organic photoconductive drum.

Figure 1:
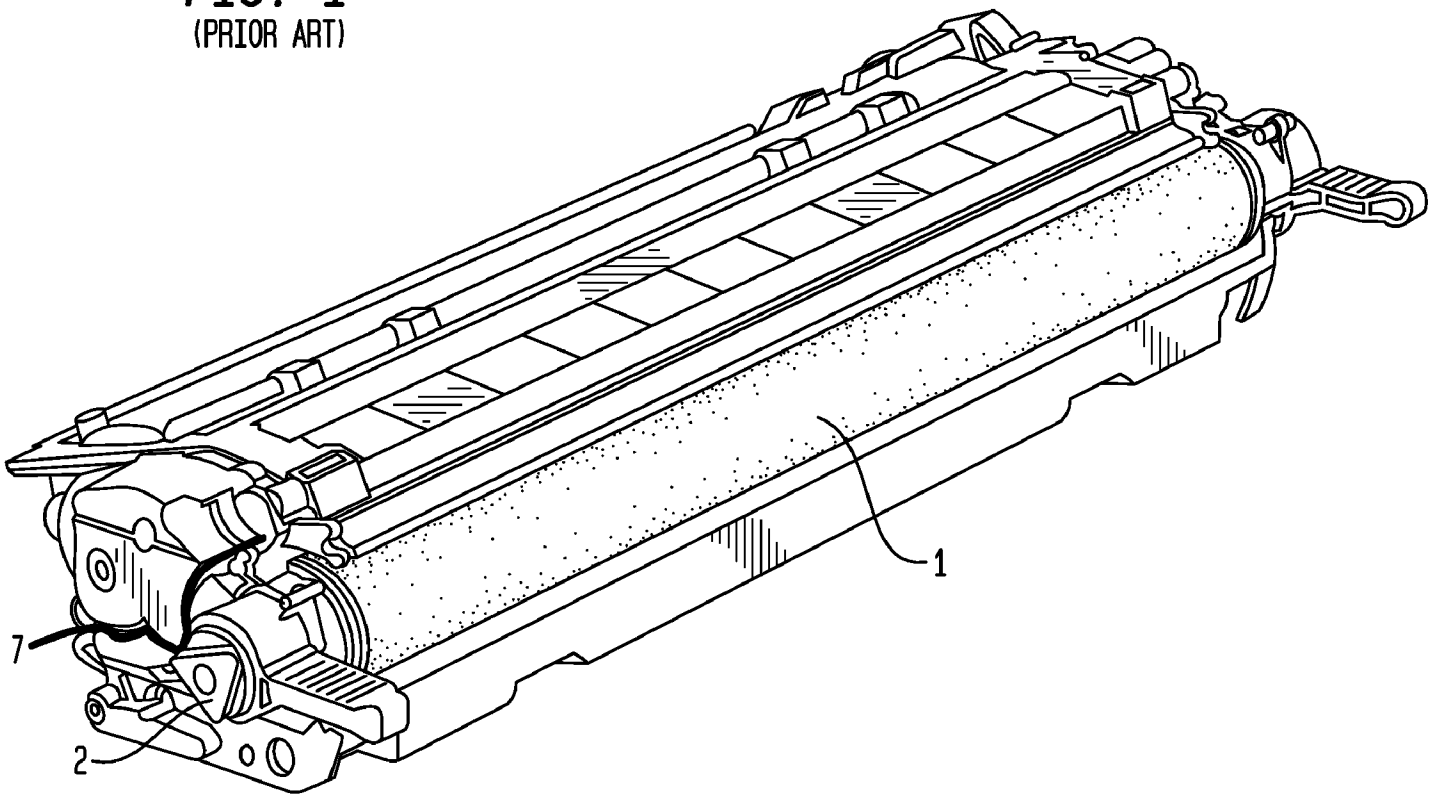
FIG. 1 (PRIOR ART)
FIG. 1 is a prior art all in one laser toner cartridge.
Figure 2:
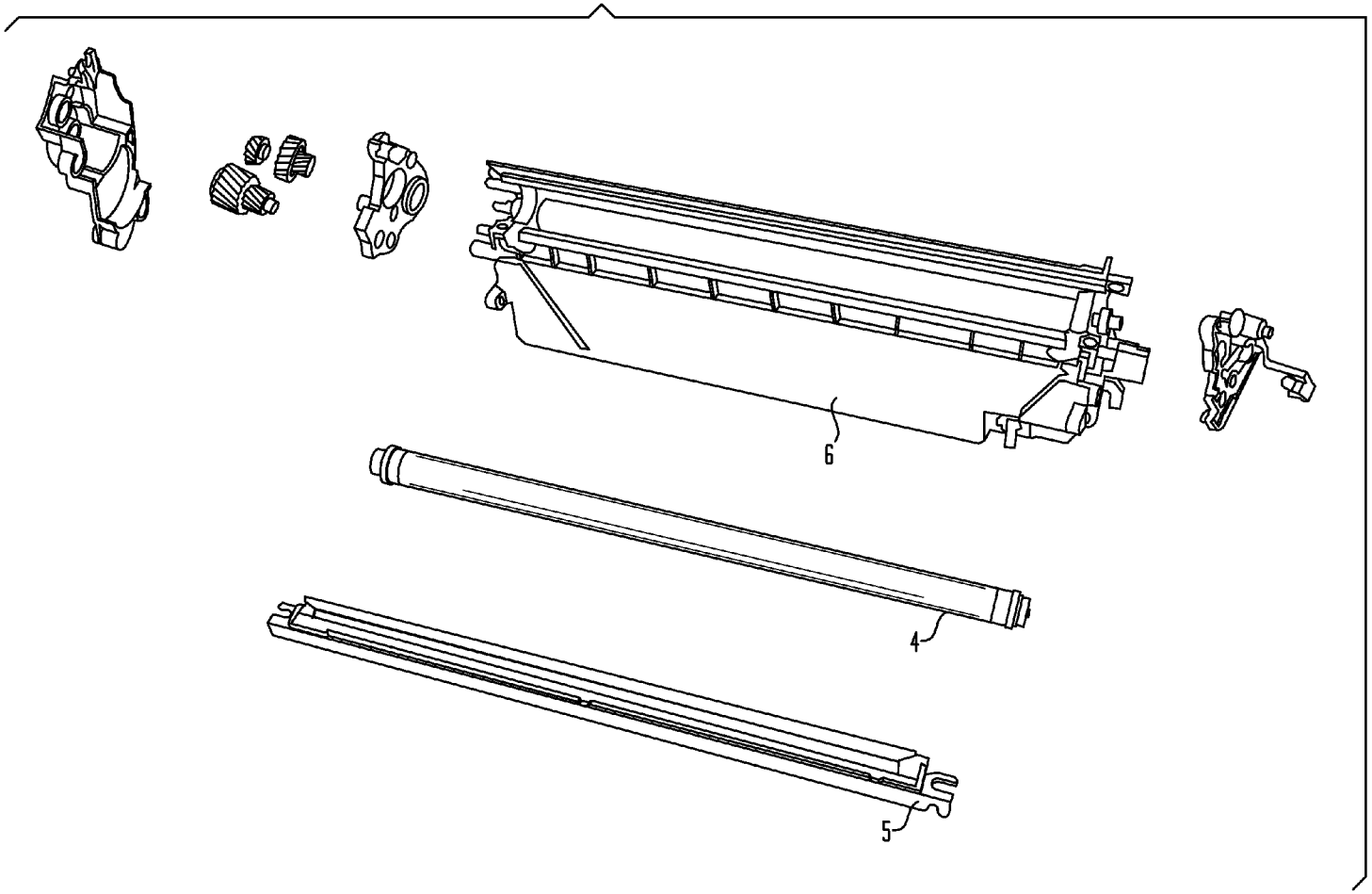
FIG. 2 (PRIOR ART)
FIG. 2 is an exploded view of the toner hopper section of a prior art all in one laser toner cartridge.

The prior art contains a number of different cartridge arrangements that may be used by OEMs. One such arrangement is illustrated in FIG. 1. FIG. 1 shows a Hewlett Packard 2600 toner cartridge. This toner cartridge has an organic photoconductive drum 1, and the organic photoconductive drum has a drive gear 2 attached to one end. The toner cartridge of FIG. 1 has two sections, a toner hopper section and a waste bin section. These sections join at the match line 7 shown in FIG. 1. A typical toner hopper section, also from a Hewlett Packard 2600 cartridge, is shown in an exploded view in FIG. 2. The toner hopper section of FIG. 2 includes a developer roller 4, a doctor blade 5 which meters the toner on the developer roller 4, and a toner hopper 6 which contains the toner used in creating the image. The toner hopper section of FIG. 2 is mated to a waste bin section shown in exploded view in FIG. 3. The waste bin section of FIG. 3 contains the organic photoconductive drum 1, a primary charging roller 8 that rests against the organic photoconductive drum 1 during printing, a cleaning blade 9 that scrapes unconsumed toner off of the organic photoconductive drum, and a waste bin 10 which holds the unconsumed toner that has been removed from the organic photoconductive drum.

Figure 5:
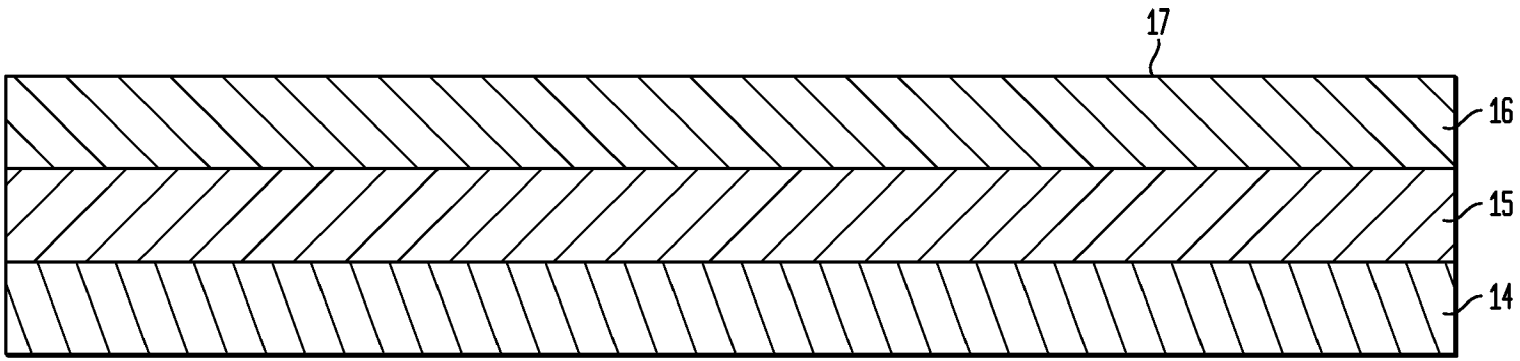
FIG. 5 (PRIOR ART)
FIG. 5 is a cross section of a prior art new organic photoconductive drum.

A different FIG. 5 shows a cross section of a typical new prior art organic photoconductive drum taken parallel to the length of the organic photoconductive drum. The typical new organic photoconductive drum has an electrically conductive substrate 14. This electrically conductive substrate is typically aluminum, but may be made of any conductive material. Moving outward from the center of the organic photoconductive drum there is a charge generation layer 15. The charge generation layer may lie directly on and in contact with the electrically conductive substrate 14, or there may be a blocking layer or an anodized layer (not shown) between the charge generation layer 15 and the electrically conductive substrate 14. The charge transport layer 16 is typically a plastic resin such as Polycarbonate that also contains chemicals that react to light by creating a relatively positive or negative charge in the areas of the charge generation layer 15 that are exposed to light. Whether the charge generated by the charge generation layer is relatively positive or negative is a function of the selected chemistry of the charge generation layer 15. Typically toner is attracted to the differentially charged parts of the drum and then transferred to the desired print media. Any toner that is not transferred to the media is removed from the organic photoconductive drum by the cleaning blade 9 for cartridges of the type shown in FIG. 1, or by the combination of the foam cleaning blade 11 and the secondary cleaning blades 12. The unused toner removed from the organic photoconductive drum then falls into the waste bin 10. The charge generation layer 15 is in electrical communication with the charge transport layer 16. The charge transport layer 16 may be in direct contact with the charge generation layer 15 as shown in FIG. 5, or there may be other layers (not shown) between the charge generation layer 15 and the charge generation layer 16. The charge transport layer 16 allows the differential charge generated by the charge generation layer 15 to be transported to the surface of the organic photoconductive drum 1. The charge transport layer 16 typically forms the surface 17 of the new organic photoconductive drum as shown in FIG. 5. The plastic resin in the charge transport layer 16 is typically a polycarbonate although other polymers such as polyvinyl butyl may be used. The charge transport layer 16 often forms the outer surface of the organic photoconductive drum although other barrier layers may also exist. These surface layers may include a variety of hard plastic resins designed to resist wear during use. The surface 17 of the new organic photoconductive drum as shown is FIG. 5 is relatively smooth and lubricious such that the charge transport layer 16 is essentially the same thickness across the surface of the organic photoconductive drum 1.

Figure 6:
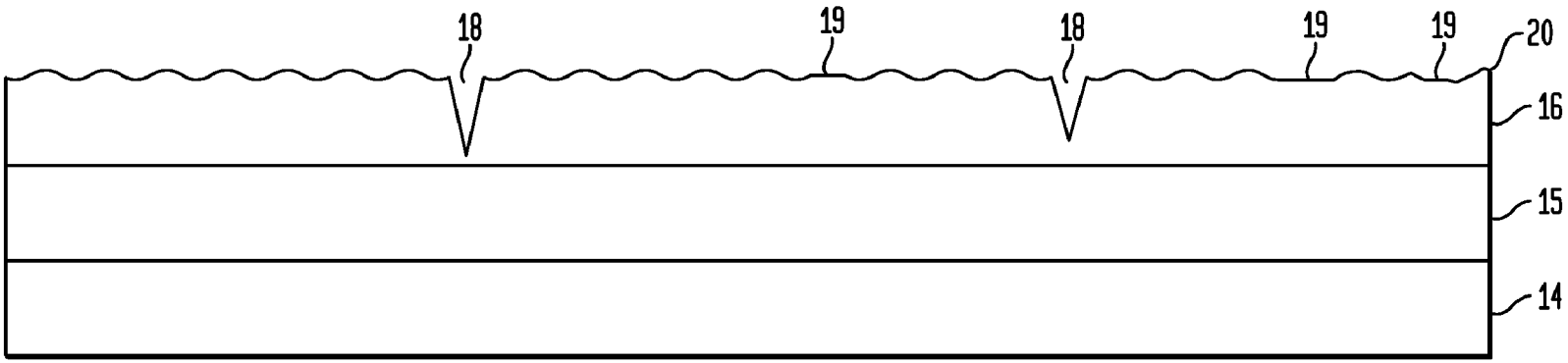
FIG. 6 (PRIOR ART)
FIG. 6 is a cross section of a prior art used organic photoconductive drum.

The gouges 18 and crazing 19 are caused by the wear of the toner and cleaning process against the organic photoconductive drum. During the printing process the organic photoconductive drum is in contact with toner, a primary charge roller, a cleaning blade, paper dust, and in some printing processes other cleaning blades and potentially a developer roller. These moving parts abrade the surface of the new organic photoconductive drum leaving an eroded surface as shown in FIG. 6.

As a result of these gouges 18, cracks or crazing 19 the outer layer of a used organic photoconductive drum may vary significantly in thickness at different points along the surface 20 of the used organic photoconductive drum. These differences in thickness of the outer layer of the used organic photoconductive drum often cause differences in electrical response of the organic photoconductive drum, and therefore the print quality. In addition, the gouges 18 and crazing 19 make the surface 20 of the used organic photoconductive drum rougher than the surface 17 of a new organic photoconductive drum. The increased roughness of the surface 20 of the used organic photoconductive drum 1 may cause the cleaning blade 9 to chatter on that surface 20; that is the cleaning blade 9 sticks to a part of the used organic photoconductive drum 1 and then slides more rapidly over the adjacent section of the used organic photoconductive drum 1 instead of exerting a uniform pressure against the entire surface of the organic photoconductive drum. Elevated levels of 'chatter' often produces a characteristic printing defect known as a cleaning defect. Although in FIG. 6 the gouges 18 and crazing 19 are show in the charge transport layer 16 the same issues would be created in the surface of a used organic photoconductive drum even if there were additional barrier layers (not shown) above the charge transport layer 16.

Figure 7:
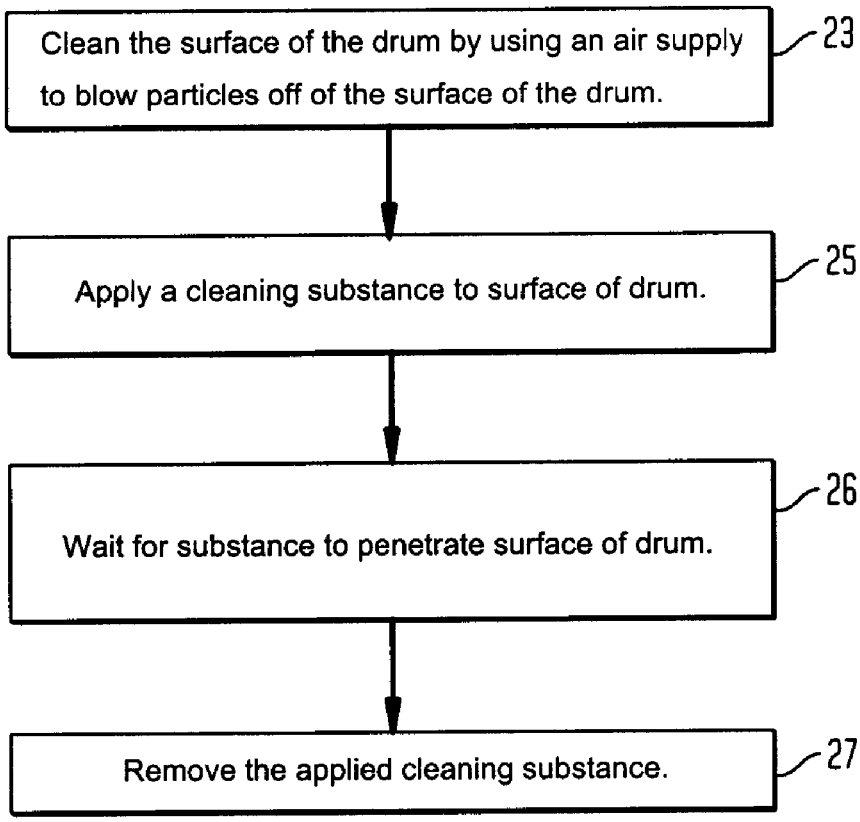
FIG. 7 shows the steps of the coating method.
Figure 8:
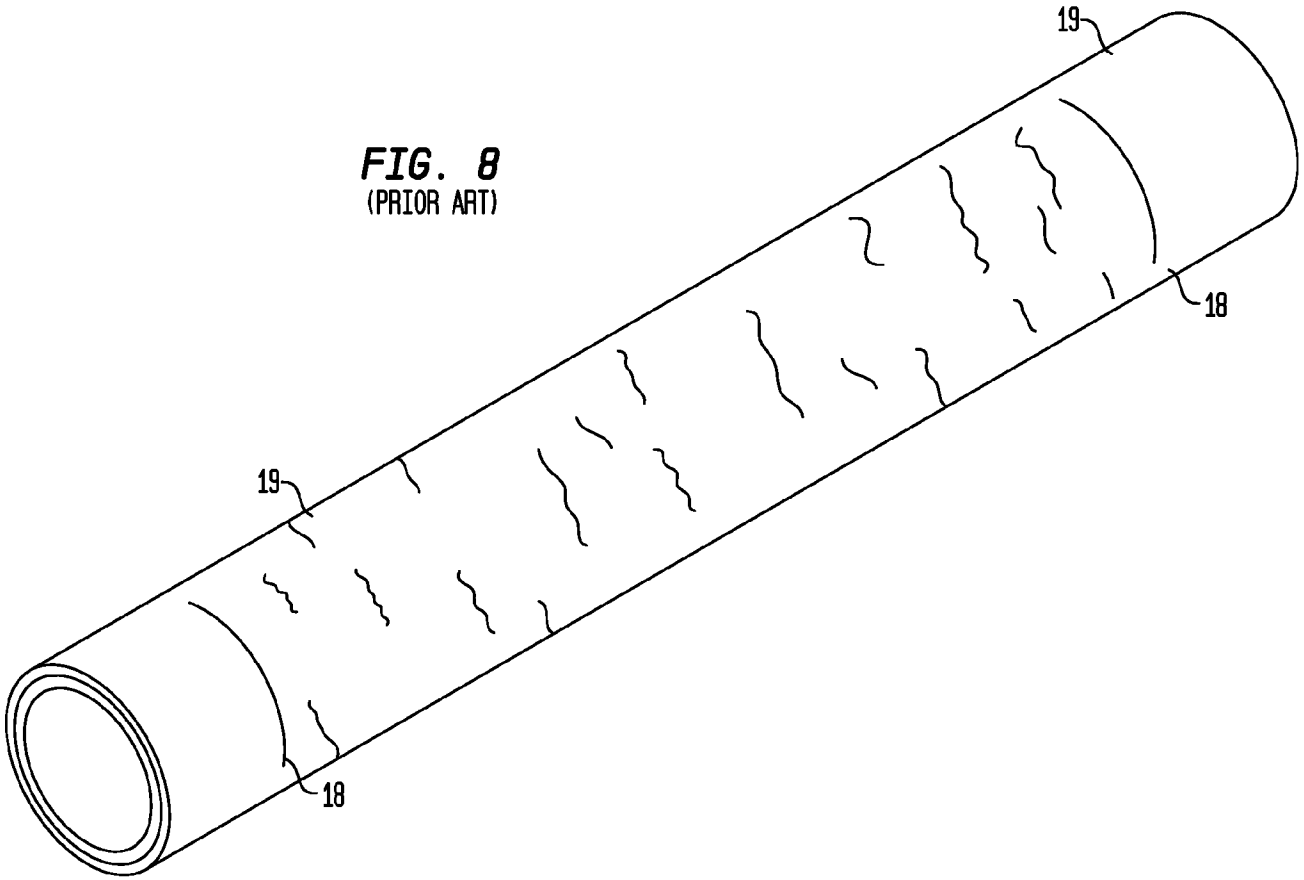
FIG. 8 (PRIOR ART)
FIG. 8 is prospective view of a prior art used organic photoconductive drum.

The method of the present invention reduces or eliminates the danger of the cleaning defect in cartridge using a used organic photoconductive drum. The steps of this method are shown in FIG. 7. The first step is to provide a used organic photoconductive drum. The used organic photoconductive drum 1 may be contained in a cartridge similar to those shown in FIGS. 1 and 4. If so, the used organic photoconductive drum is preferably removed from the cartridge before the coating process. The used organic photoconductive drum may be coated in place in its cartridge, but it is easier to clean and coat if the used organic photoconductive drum is first removed.

After the used organic photoconductive drum 1 in removed from the cartridge or frame that it was contained in, the surface 20 of the used organic photoconductive drum 1 should be cleaned 23. The surface 20 of the used organic photoconductive drum may have a variety of particles on the surface 20, including particles of toner, paper or even plastic debris. The surface 20 may be cleaned 23 in a variety of ways. One method of cleaning 23 is to use an air supply to blow the particles of toner off of the surface of the organic photoconductive drum. The surface 20 may also be cleaned using any of a number of cleaning fluids. These cleaning fluids may be applied to an applicator and then rubbed against the organic photoconductive drum. Less preferably, the organic photoconductive drum could be dipped into the cleaning fluid.

One such cleaning fluid is an alcohol such as isopropyl alcohol. A solvent could also be used as the cleaning fluid, although care would have to be taken in selecting the solvent to insure that the solvent did not attack the surface 20 of the organic photoconductive drum. The preferred cleaning fluid is a dielectric non-polar liquid 31 with a viscosity of less than 200 Centistokes (cSt) measured at 40 degrees Celsius because in this manner the step of cleaning 23 the surface 20 of the used organic photoconductive drum 1 can be combined with the step of applying a dielectric non-polar liquid 25 as set forth below. The preferred dielectric non-polar liquid is discussed below in connection with the step of providing a dielectric non-polar liquid.

Figure 12:
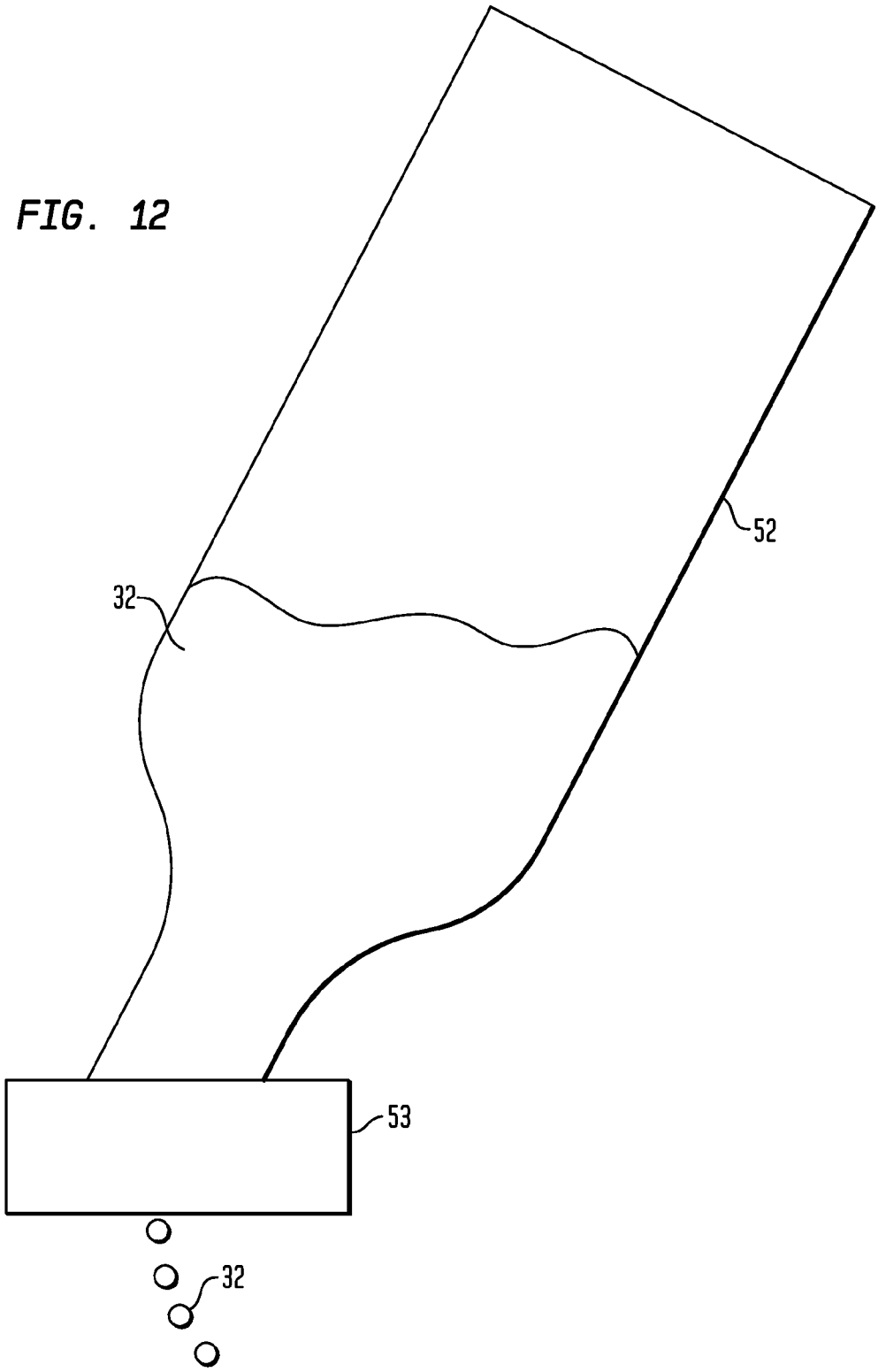
FIG. 12 is a cross section of an applicator.

The preferred method of cleaning the surface of the used organic photoconductive drum is to place the dielectric non-polar liquid 32 on an applicator 31 and then gently rubbing the applicator 31 along the length of the used organic photoconductive drum 1. The applicator 31 may be a sponge, paper towel, newspaper or cloth but is preferably a substantially lint free cloth. One such cloth is C3 manufactured by John R. Lyman Company. It is a low lint polyester cloth although there are many suitable alternatives. The applicator 31 may be soaked in the dielectric non-polar liquid 32, a metered amount of the dielectric non-polar liquid 32 may be placed on an applicator 31, or the applicator 31 may be a porous lid placed over a container of the dielectric non-polar liquid 32 as shown in FIG. 12. The applicator 31 shown in FIG. 12 is a container 52 holding the dielectric non-polar liquid 32. One end of the container is leakably sealed with a porous lid 53 that is made from a material with will allow the dielectric non-polar liquid to seep through the porous lid. The porous lid 53 may then be placed against the surface 20 of the used organic photoconductive drum.

No matter what type of applicator 31 is used, toner particles from the surface 20 of the used organic photoconductive drum will adhere to the applicator 31 making the applicator 31 dirty. Clean areas of the applicator 31 are preferably placed against the surface 20 of the used organic photoconductive drum during the cleaning process to ensure a thorough cleaning of the surface 20.

Although the organic photoconductive drum 1 could be cleaned by holding the organic photoconductive drum in one hand and rubbing it with an applicator 31 in the preferred embodiment a machine is used to hold and rotate the organic photoconductive drum 1 during the cleaning process. While one machine could be used to assist in cleaning the used organic photoconductive drum and the drum could be coated with a different machine or by hand, it is more economical to clean and coat the drum using the same mechanism. These machines will be discussed in more detail below.

After cleaning the surface 20 of the used organic photoconductive drum, a suitable coating material needs to be obtained. The preferred coating material will restore the electrical characteristics of the surface 20 of a used organic photoconductive drum to those more like the surface 17 of a new organic photoconductive drum. The preferred coating material will remain on the surface 20 of the used organic photoconductive drum during the next use of the used organic photoconductive drum, and will not interfere with the electrical charges that transfer toner from the developer roller 4 to the organic photoconductive drum 1 to the media such as paper.

The coating of this invention is a dielectric non-polar liquid with a viscosity of less than 200 cSt measured at 40 degrees C., more preferably between 25 and 125 cSt and a surface energy less than the surface 20 of the used organic photoconductive drum. Because the liquid is dielectric, it will restore some of the insulating characteristics similar to the surface 17 of a new organic photoconductive drum in those areas of the surface 20 of the used organic photoconductive drum that have been thinned by gouges 18 or crazing 19. A certain amount of additional insulative material on the surface of the used organic photoconductive drum is desirable, but not too much, as set forth below. Because the liquid is non-polar the liquid will not electrically attract or repel toner particles and therefore will not interfere with the electrically mediated transfer of the toner. The viscosity of the dielectric non-polar liquid is important for several reasons. If the viscosity is below 10 cSt, then some of the dielectric non-polar fluids will be too volatile, and may evaporate from the surface 20 of the used organic photoconductive drum before the organic photoconductive drum can complete its second cycle of use. Similarly some, but not all, of the 10 cSt or less dielectric non-polar liquids may act like a solvent and attack other components in the cartridges.

On the other hand, if the dielectric non-polar liquid is too viscous then print defects such as backgrounding become more of an issue. Our experiments show that above a viscosity of about 200 cSt backgrounding becomes unacceptable. The increased viscosity appears to be related to the thickness of the layer of dielectric non-polar material on the surface of the coated drum. The greater the viscosity, the greater the thickness the layer of dielectric non-polar liquid, and therefore the greater the electrical resistance of that layer. In addition the more viscous dielectric non-polar liquids do not wet out as quickly as the less viscous dielectric liquids even if the surface energy are similar.

The dielectric non-polar liquid 32 must have a surface energy less than the surface energy of the surface 20 of the used organic photoconductive drum. This difference in surface energy means that the dielectric non-polar liquid will wet out the surface 20 of the used organic photoconductive drum. The difference in surface energy is also directly proportionate to the degree to which the dielectric non-polar liquid will stick to the surface 20 of the used organic photoconductive drum. This point will be discussed further below. Finally, the dielectric non-polar liquid should be non-volatile that is it must not suffer appreciable evaporative loss during the cycle of use of the coated used organic photoconductive drum.

There are many suitable dielectric non-polar materials. Silicone oils, mineral oils, and vegetable oils all include dielectric non-polar liquids with the required viscosity and surface energy characteristics. For example, Dow 200, a silicone oil, comes in a variety of viscosities including from 0.65 cSt to 200 cSt. Higher viscosities lack good flow characteristics, and therefore may not readily reflow to areas of the coated organic photoconductive drum that are abraded during use after coating. The preferred dielectric non-polar liquid is a silicone oil such as Dow 200 with a viscosity of less than 200 cSt, more preferably a silicone oil with a viscosity of 25 to 125 cSt, more preferably still a silicone oil with a viscosity of 50 cSt. Silicone oils in these viscosity ranges have a surface energy of around 19 to 21 dynes per centimeter and are non-volatile. Similarly another preferred dielectric non-polar liquid is a mineral oil such as the mineral oils distributed by Mallot and Company Inc. preferably the K lube with a viscosity range 38.4 to 41.5 at 40 degrees Celsius. Mallot and Company Inc. offers other suitable mineral oils with viscosities of less than 200 cSt, preferably between 25 cSt and 125 cSt. These mineral oils have a surface energy of around 30 dynes per centimeter and are non-volatile. While the silicone oil and mineral oil referenced above are from certain manufacturers or distributors, many other manufacturers or distributors offer dielectric non-polar liquids with a viscosity less than 200 cSt, a surface energy less than the surface energy of the surface 20 of a used organic photoconductive drum and which are non-volatile. Vegetable oils will also work.

After a suitable dielectric non-polar liquid 32 has been selected the dielectric non-polar liquid 32 should be applied to the surface of a used organic photoconductive drum. As in the cleaning step 23 a variety of means for applying 25 the dielectric non-polar liquid 32 to the surface 20 of the used organic photoconductive drum may be used. The dielectric non-polar liquid may be sprayed onto the surface 20 of the used organic photoconductive drum. The organic photoconductive drum may be dipped into the dielectric non-polar liquid. Perhaps most simply, an applicator 31, preferably a substantially lint free cloth wetted with the dielectric non-polar liquid 32 is placed against the surface 20 of the used organic photoconductive drum and rubbed against the surface 20. The organic photoconductive drum 1 can be held in one hand and the applicator 31 rubbed against the surface with the other hand. Alternatively, a variety of fixtures may be built to hold the used organic photoconductive drum while a applicator 31 is applied against the surface of the drum. Instead of a cloth a variety of other applicators 31 may be used as discussed in the cleaning step above.

If the organic photoconductive drum is not removed from the cartridge before the step of cleaning 23 and applying 25 then there is some risk that excess dielectric non-polar fluid will deposit on other components of the cartridge such as the cleaning blade 9 or the primary charge roller 8 which may impact print performance. For this reason, in a preferred embodiment of the method of this invention the used organic photoconductive drum is removed from any cartridge that it is in before the steps of cleaning 23 or applying 25.

Figure 10:
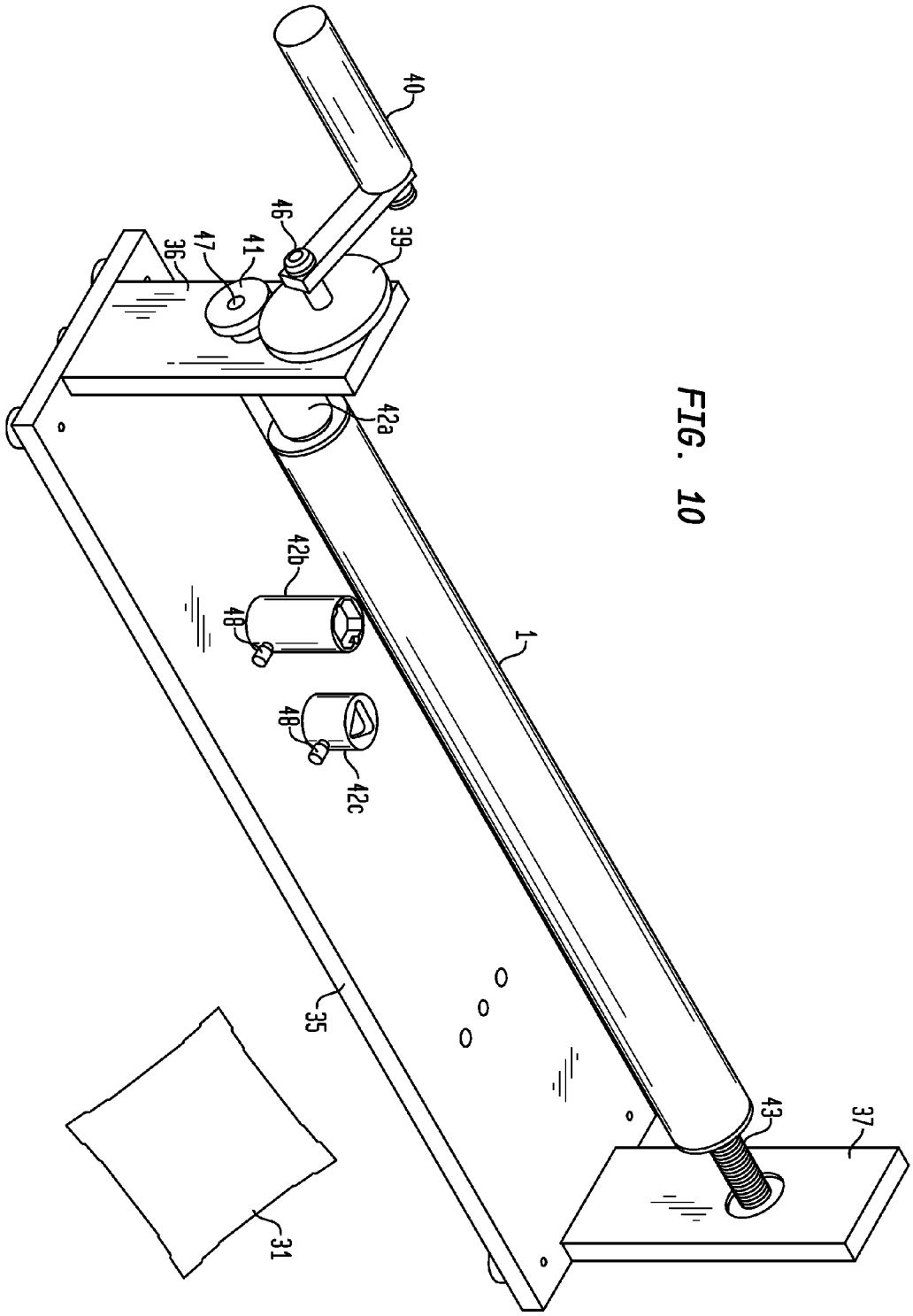
FIG. 10 is a prospective view of a device used for cleaning and coating a used organic photoconductive drum.
Figure 11:
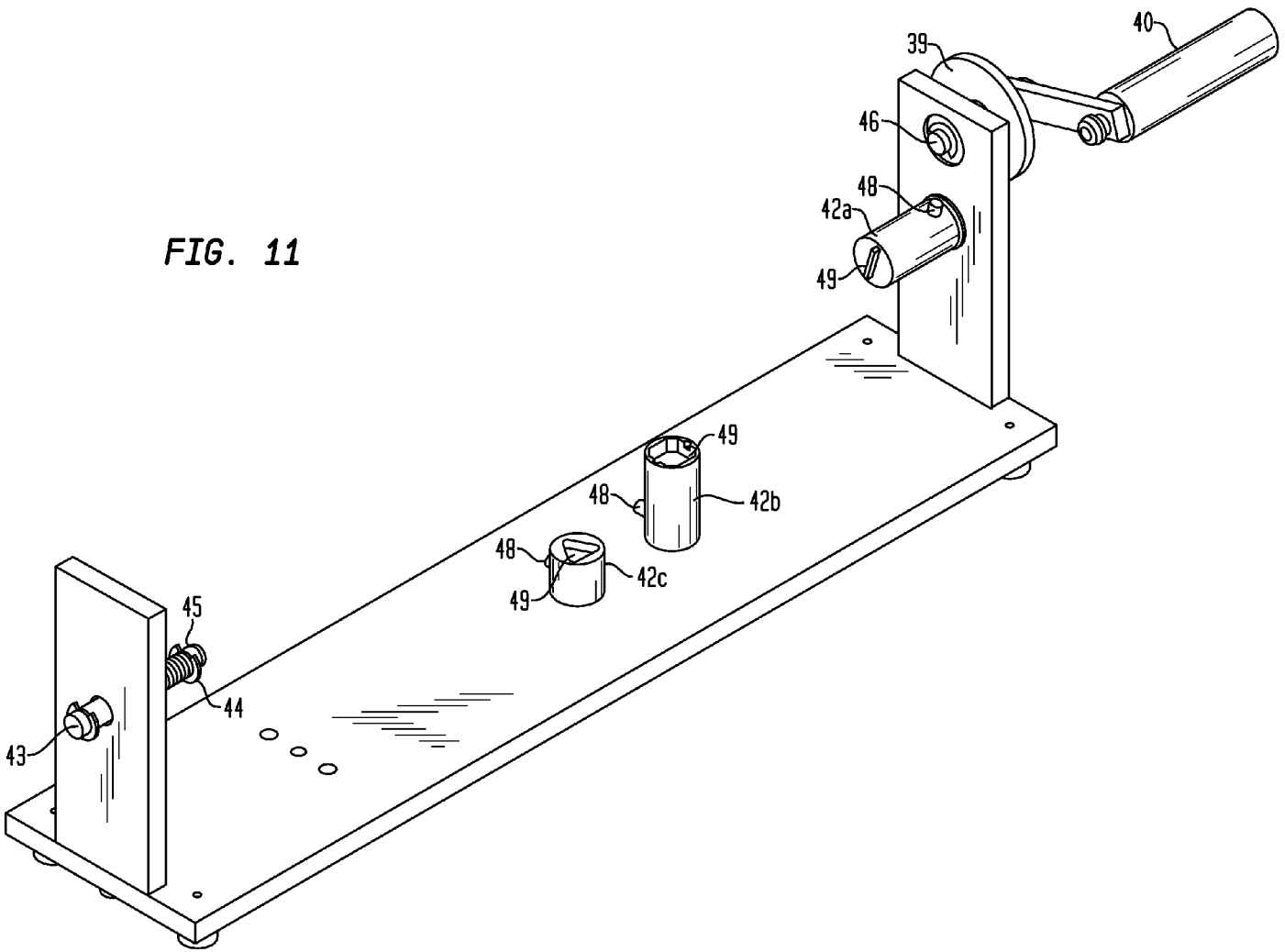
FIG. 11 is a different prospective view of a device used for cleaning and coating a used organic photoconductive drum.

A fixture such as that illustrated in FIGS. 10 and 11 may be used for the steps of cleaning 23 a used organic photoconductive drum 1 that has been removed from a cartridge and applying 25 a dielectric non-polar liquid to the surface 20. The fixture has a base 35. Attached to the base is a drive side support 36 and a hub side support 37. Attached to the drive side support 36 is an axis 46 that in turn is connected to a drive wheel 39. The drive wheel 39 has a handle 40. When an operator turns the handle 40, the drive wheel 39 rotates. The drive wheel 39 is in contact with a transmitting wheel 41. The drive wheel 39 could drive the transmitting wheel 41 rotation by friction, but preferably the drive wheel 39 and the transmitting wheel 41 are connected by gear teeth. The gear wheel size or additional gearing can be used to select the desired speed of rotation. As the transmitting wheel 41 rotates its axis 47 also rotates. The transmitting wheel axis 47 in turn rotates a drive gear coupling 42. The drive gear coupling 42 has two ends, a drive gear coupling end 49 shaped to engage the various shapes of drive gears and a transmitting wheel axis end (not shown) shaped to receive the transmitting wheel axis. Different drive gear coupling ends 49 are shown in FIGS. 10 and 11 as drive gear couplings 42*a*, 42*b* and 42*c*. The drive gear coupling 42 is held onto the axis by a set screw 48. The organic photoconductive drum 1 is placed in the fixture so that the drive gear 2 engages the drive gear coupling 42. The opposite end of the organic photoconductive drum is placed over the hub pin 43 which has a flange 44 for contacting the organic photoconductive drum. The flange is pressed against the hub 50 of organic photoconductive drum by a spring 45. The hub pin 43 shown in FIGS. 10 and 11 is designed to fit into the hub 50 of the organic photoconductive drum. The spring 45 and flange 44 press against the hub 50 and cause the drive gear to be pressed into the drive gear coupling insuring a good connection between the two. When the handle is turned, the organic photoconductive drum is rotated. Although the fixture depicted in FIGS. 10 and 11 is hand driven, the transmitting wheel could be driven by a motor.

These fixtures could be used in either the step of cleaning 23 or applying 25 or more preferably in the combined cleaning 23 and applying 25 step. An applicator 31 is placed against the surface of the organic photoconductive drum as the fixture rotates the organic photoconductive drum 1. The applicator 31 is moved along the length of the drum multiple times, preferably multiple times to insure that the entire surface 20 of the used organic photoconductive drum is contacted. If the applicator 31 is also being used to clean the surface 20 of the used organic photoconductive drum then care should be taken to insure that as areas on the applicator 31 become dirty clean areas of the applicator are applied to the surface 20 of the used organic photoconductive drum.

After the dielectric non-polar liquid 32 is applied to the surface 20 of the used organic photoconductive drum then, in the preferred embodiment, the dielectric non-polar liquid 32 is allowed to sit on the surface 20 of the used organic photoconductive drum for at least about one minute before the next step. This step of waiting 26 gives the dielectric non-polar liquid 32 time to wet out, or to penetrate any pores, gouges 18 or crazing 19 in the surface 20 of the used organic photoconductive drum filling these areas with the dielectric non-polar liquid 32. The waiting period also provides for a better adherence between the surface 20 of the used organic photoconductive drum. The more viscous the dielectric non-polar liquid that is used, the more time that should be allowed for this waiting period. To ensure plenty of time is available the preferred waiting time for all of the dielectric non-polar liquids with a viscosity of less than 200 cSt is more than five minutes, more preferably about 15 minutes.

After the step of waiting 26 the final step is to remove any excess dielectric non-polar liquid from the surface 20 of the used organic photoconductive drum. Excess dielectric non-polar liquid in the context is defined as any of the dielectric non-polar liquid that is on the surface 20 of the used organic photoconductive drum that can be easily removed mechanically without the use of solvents or detergents. The simplest and preferred method of removing any excess dielectric non-polar liquid is to rub the coated organic photoconductive drum with a dry cloth, preferably a lint free cloth such as the non-woven poly Rayon, part number 5500 offered by Contec Inc. The excess liquid will be absorbed into the cloth. As in the cleaning step 23 or the applying step 25 other items such as paper towels, newspapers, sponges, squeegees or the like may be used to remove the excess dielectric non-polar liquid 32. If the excess dielectric non-polar liquid is not removed then toner may adhere to the excess liquid causing clumping of toner and debris on the surface 20 of the organic photoconductive drum or the cleaning blade 9 or the primary charge roller 8 causing a variety of print defects. It is possible to meter onto the surface 20 of the used organic photoconductive drum the precise amount of dielectric non-polar liquid that is required for that particular type of organic photoconductive drum so that the step of removing 27 is not required. However, as a practical matter it is better to apply more dielectric non-polar liquid 32 than is required to ensure a thorough coating of the surface 20 of the organic photoconductive drum, and then subsequently remove any excess dielectric non-polar liquid 32.

Figure 9:
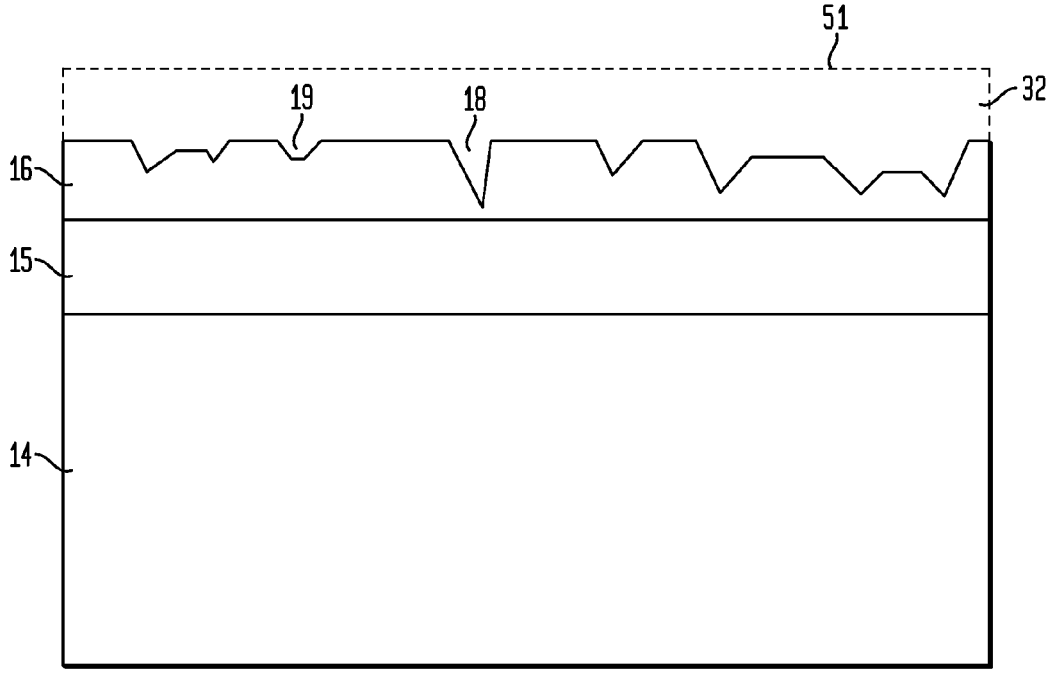
FIG. 9 is a cross section of a coated used organic photoconductive drum.

FIG. 9 is a cross section of a used organic photoconductive drum with a layer of dielectric non-polar liquid 32 over the surface 20 of the used organic photoconductive drum. The dielectric non-polar liquid fills the pores gouges 18 or crazing 19 in the surface 20 of the used organic photoconductive drum and creates a smoother surface 51 for the coated organic photoconductive drum. The thickness of the dielectric non-polar liquid layer will vary being thicker in those areas where the surface 20 of the used organic photoconductive drum were gouged 18 or crazed 19 and thinner in the less damaged areas of the surface 20.

The dielectric non-polar liquid coated organic photoconductive drum of this invention provides a surprisingly durable surface layer. One of the most popular recent toner cartridges are the cartridges that are compatible with the Hewlett Packard 2600 printer. The electrically conductive substrate 14 on the Hewlett Packard 2600 organic photoconductive drums is aluminum. The thickness of the coating on this electrically conductive substrate 14 was measured at different times. After the initial cycle of a Hewlett Packard 2600 toner cartridge the used organic photoconductive lost approximate 1 micron from the surface layer of the organic photoconductive drum. After coating with the process described above, the layers above the aluminum substrate of the coated organic photoconductive drum increased in thickness by approximately 0.5 microns. After the coated organic photoconductive drum was reused in a second printing cycle, the coated Hewlett Packard 2600 organic photoconductive drum lost less than 0.5 microns. A used organic photoconductive drum coated with this method should be able to be recoated and used more than once. The coated used organic photoconductive drum of this invention does not exhibit the cleaning defect of an uncoated used organic photoconductive drum.

In addition the coated organic photoconductive drum shows improved electrical characteristics over a used photoconductive drum. Again, the popular Hewlett Packard 2600 cartridge was used as a reference. The organic photoconductive drum 1 is negatively charged by the primary charge roller 8. During the printing process, after the organic photoconductive drum is charged a laser writes to the surface of the organic photoconductive drum. Those are of the drum that are written to become less negatively charged (or relatively more positively charged). The voltages on four organic photoconductive drums were measured when the organic photoconductive drum was new, after the organic photoconductive drum had been used for one printing cycle, i.e. after the initial toner load had been consumed during printing, and after the used organic photoconductive drum had been coated with a 100 cSt Dow 200 silicone oil.

The used organic photoconductive drum was placed in an apparatus similar to that shown in FIGS. 10 and 11, cleaned with a cloth impregnated with the 100 cSt Dow 200 silicone oil. The silicone oil impregnated cloth was passed down the length of the organic photoconductive drum 4 times. On each pass the silicone oil impregnated cloth was folded over to expose a clean section of the cloth to the surface of the organic photoconductive drum. After the surface 20 was cleaned and coated, the coated organic photoconductive drum was allowed to rest for 15 minutes out of the light. The excess dielectric non-polar liquid was then wiped off of the surface 20 of the used organic photoconductive drum with four passes of a clean dry lint free cloth along the length of the organic photoconductive drum. Again, an apparatus similar to that shown in FIGS. 10 and 11 was used to rotate the organic photoconductive drum while the dry lint free cloth was applied to the organic photoconductive drum. The difference between the apparatus used, and that depicted in FIGS. 10 and 11 is that the apparatus used was driven by an electric motor rather than by the hand crank shown in FIGS. 10 and 11.

We have evaluated the charge acceptance characteristics of the coated organic photoconductive drum by comparing the charge acceptance of new organic photoconductive drums, once used organic photoconductive drums, and coated once used organic photoconductive drums under certain printing scenarios. The coated once used photoconductive drums showed improved charge acceptance characteristics that were more like a new organic photoconductive drum than were the used organic photoconductive drum.

Four randomly selected new Hewlett Packard 2600 organic photoconductive drums were placed into printers, and the charge acceptance was measured inside the toner cartridge as six different print targets were printed. The charge acceptance was measured during printing by Trek Electrostatic Voltmeter. Four different once used organic photoconductive drums that were randomly removed from once used Hewlett Packard 2600 cartridges. The charge acceptance of these once used organic photoconductive drums was then measured while printing the six test targets, again using the Trek Electrostatic Voltmeter. Then these same once used organic photoconductive drums were coated using the a 100 cSt Dow 200 silicone oil using the method described above, and the charge acceptance of these coated once used organic photoconductive drums were then measured while printing the six test targets. The results for the tests were then averaged. The print tests used were a blank black page, a 30% black page, a 100% black page, a 4 bar page, and a color page, all generated using a print test target generated by TargetPro, a print test target generator available from Static Control. A sixth set of measurement were then taken using the OEM demo page that comes with the Hewlett Packard printer. All measurements were made with the various organic photoconductive drums placed in the black cartridge.

For the blank black test page, the new organic photoconductive drums had an average charge acceptance of −556.25 volts, the once used organic photoconductive drums had an average charge acceptance of −566.40 volts, and the once used and coated organic photoconductive drums had an average charge acceptance of −550 volts.

For the 30% black page test page, the new organic photoconductive drums had an average charge acceptance of −511.71 volts, the once used organic photoconductive drums had an average charge acceptance of −524.21 volts, and the once used and coated organic photoconductive drums had an average charge acceptance of −510.15 volts.

For the 100% black test page, the new organic photoconductive drums had an average charge acceptance of −499.21 volts, the once used organic photoconductive drums had an average charge acceptance of −524.92 volts, and the once used and coated organic photoconductive drums had an average charge acceptance of −505.46 volts.

For the 4 color bar test page, the new organic photoconductive drums had an average charge acceptance of −517.18 volts, the once used organic photoconductive drums had an average charge acceptance of −533.59 volts, and the once used and coated organic photoconductive drums had an average charge acceptance of −521.09 volts.

For the color test page, the new organic photoconductive drums had an average charge acceptance of −521.09 volts, the once used organic photoconductive drums had an average charge acceptance of −528.90 volts, and the once used and coated organic photoconductive drums had an average charge acceptance of −520.31 volts.

For the OEM demo test page, the new organic photoconductive drums had an average charge acceptance of −539.06 volts, the once used organic photoconductive drums had an average charge acceptance of −549.21 volts, and the once used and coated organic photoconductive drums had an average charge acceptance of −535.15 volts Thus, as can be seen, in each of the various print tests, the coated organic photoconductive drums showed improved charge acceptance characteristics that may account, in part, for the improved print performance of the coated used organic photoconductive drum when compared to a used organic photoconductive drum.

The lubricity and relatively low surface energy of the dielectric non-polar fluids when compared to the roughness and higher surface energy of the surface 20 of a used organic photoconductive drum also contribute to the better print performance, less chatter with the cleaning blade. The surface energy differential also helps ensure that the dielectric non-polar liquid will remain on the surface 20 of the used organic photoconductive drum for a second cycle Although the tests above reference a Hewlett Packard 2600 organic photoconductive drum the same results will occur with other organic photoconductive drums no matter what type of dry toner imaging device the organic photoconductive drum may be used in.

Once a organic photoconductive drum has been recoated using the above method it may be used in a remanufactured cartridge saving the remanufacturer the cost of buying an new replacement organic photoconductive drum. The remanufacturer, coating a used organic photoconductive drum using the above described method, may install that coated organic photoconductive drum in a remanufactured cartridge. A toner cartridge like that shown in FIG. 1 is first separated into its two halves, the toner hopper section shown in FIG. 2 and the waste bin section shown in FIG. 3 by the well know process of removing certain screws and springs. The used organic photoconductive drum 1 is then removed and is either coated using the above described process, or replaced with a different coated used organic photoconductive drum. The used organic photoconductive drum 1, may be either the original equipment manufacturer's or a third party manufacturer's used organic photoconductive drum. The coating process may also be used on a new organic photoconductive drum to improve its electrical and wear characteristics.

Figure 3:
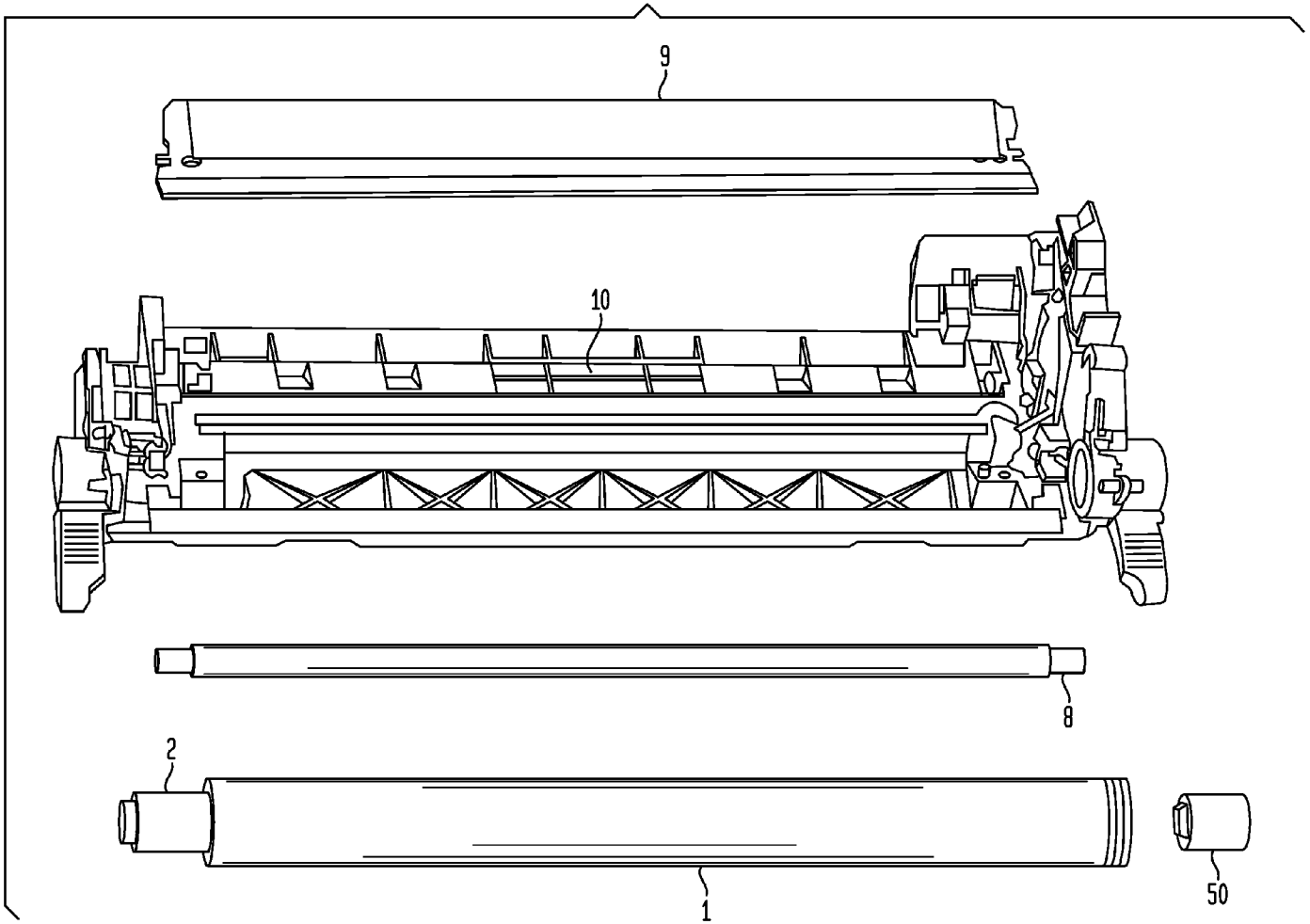
FIG. 3 (PRIOR ART)
FIG. 3 is an exploded view of the waste bin section of a prior art all in one laser toner cartridge.

After the used organic photoconductive drum is removed from the waste bin section shown in FIG. 3, the remanufacturer may inspect the other components such as the primary charge roller 8, or the cleaning blade 9. These components should be replaced if they are damaged. The waste toner is preferably removed from the waste bin 10, and excess toner removed from the various components. The components are replaced, and the coated organic photoconductive drum 1 is reinstalled.

Similarly, the remanufacturer inspects the toner hopper section shown in FIG. 2. He may replace the doctor blade 5 or developer roller 4. Any excess toner is removed from the various components including the toner hopper 6. New toner is added to the toner hopper 6, and the toner hopper section shown in FIG. 2 is reassembled, and reattached to the waste bin section shown in FIG. 3.

Figure 4:
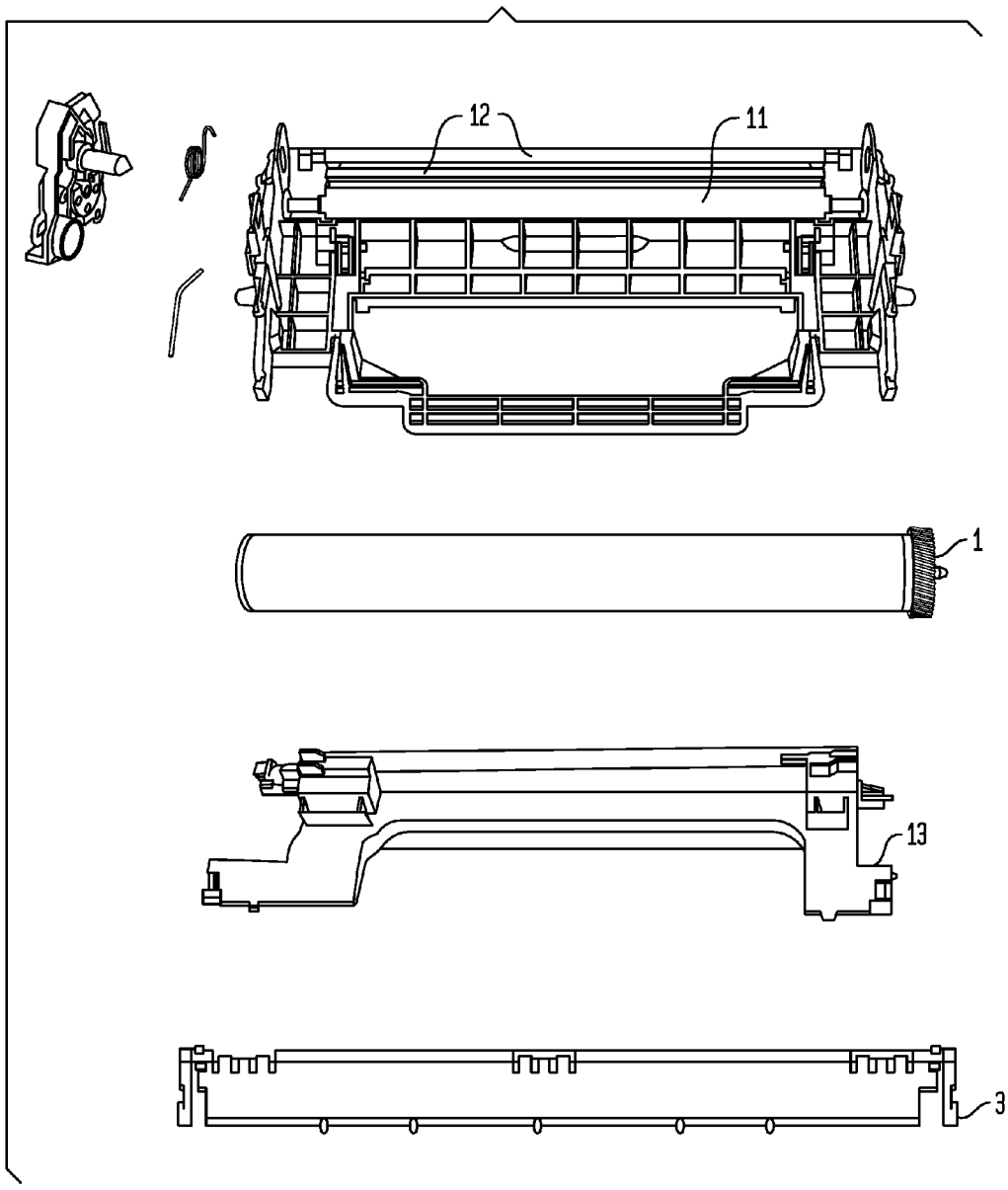
FIG. 4 (PRIOR ART)
FIG. 4 is an exploded view of a prior art drum cartridge.

Although reference is made to the remanufacturing method for the cartridge shown in FIGS. 1, 2 and 3, the same or similar process will apply to other designs of cartridges including those cartridges which are drum cartridges only such as that shown in FIG. 4.

A method of recoating an organic photoconductive drum may comprise: providing a used organic photoconductive drum, said used organic photoconductive drum having been previously used in an electro photographic process, said electro photographic process using dry toner, said used organic photoconductive drum having a first surface, said used organic photoconductive drum comprising a conductive substrate, a charge generation layer disposed between said conductive substrate and said first surface of said used organic photoconductive drums, a charge transport layer being disposed between said charge generation layer and said first surface; cleaning the first surface of said organic photoconductive drum; providing a dielectric non-polar liquid having a viscosity less than 200 cSt at 40 degrees Celsius, said dielectric non-polar liquid having a surface energy less than a surface energy of the first surface of said used organic photoconductive drum; and applying the dielectric non-polar liquid to the first surface of the used organic photoconductive drum to form a second surface on the used organic photoconductive drum comprising a layer of said dielectric non-polar liquid.

The method may also comprise: removing at least a portion of any excess dielectric non-polar liquid from the second surface of said organic photoconductive drum leaving a thinner layer of said dielectric non-polar liquid.

The method may also comprise before removing at least a portion of any excess dielectric non-polar liquid waiting at least one minute after applying said dielectric non-polar liquid to the first surface of the used organic photoconductive drum.

The method may include wherein the dielectric non-polar liquid is non-volatile.

The method may include wherein the dielectric non-polar liquid is an oil.

The method may include wherein the oil is a mineral oil.

The method may include wherein the oil is a silicone oil.

The method may include wherein the layer of dielectric non-polar liquid is less than 5 microns thick.

The method may include wherein at least a portion of any excess dielectric non-polar liquid is removed from the second surface by applying a dry lint free cloth to the second surface.

The method may include wherein the viscosity of the dielectric non-polar liquid is between 25 and 125 cSt at 40 degrees Celsius.

A method of recoating an organic photoconductive drum may comprise: providing a used organic photoconductive drum, said used organic photoconductive drum having been previously used in an electro photographic process, said electro photographic process using dry toner, said used organic photoconductive drum having a first surface, said used photoconductive drum comprising a conductive substrate, a charge generation layer disposed between said conductive substrate and said first surface of said used organic photoconductive drums, a charge transport layer being disposed between said charge generation layer and said first surface; providing a dielectric non-polar liquid having a viscosity of less than 200 cSt at 40 degrees Celsius, said dielectric non-polar liquid having a surface energy less than a surface energy of the first surface of said used organic photoconductive drum; and applying said dielectric non-polar liquid to the first surface of the used organic photoconductive drum to form a coated organic photoconductive drum having a second surface comprising a layer of said dielectric non-polar liquid, wherein applying the dielectric non-polar liquid cleans the first surface of said used organic photoconductive drum.

The method may include wherein the dielectric non-polar liquid is a mineral oil.

The method may include wherein the dielectric non-polar liquid is a silicone oil.

The method may further comprise waiting at least one minute after applying the dielectric non-polar liquid and then removing at least a portion of any excess dielectric non-polar liquid from the surface of the coated organic photoconductive drum.

A method of remanufacturing a used laser toner cartridge may comprising providing a used organic photoconductive drum, said used organic photoconductive drum having been previously used in an electro photographic process, said electro photographic process using dry toner, said used organic photoconductive drum having a first surface, said used organic photoconductive drum comprising a conductive substrate, a charge generation layer disposed between said conductive substrate and said first surface of said used organic photoconductive drums, a charge transport layer being disposed between said charge generation layer and said first surface; cleaning the first surface of said used organic photoconductive drum; providing a dielectric non-polar liquid having a viscosity of less than 200 cSt at 40 degrees Celsius, said dielectric non-polar liquid having a surface energy less than a surface energy of the first surface of said used organic photoconductive drum; applying said dielectric non-polar liquid to the first surface of the used organic photoconductive drum to form a coated organic photoconductive drum having a second surface comprising a layer of said dielectric non-polar liquid; providing a toner cartridge having a mount adapted for receiving an organic photoconductive drum; and installing the refurbished organic photoconductive drum in the mount adapted for receiving an organic photoconductive drum section.

The method may further comprise adding toner to the toner cartridge.

The method may comprise removing at least a portion of any excess dielectric non-polar liquid from the second surface of the coated organic photoconductive drum.

The method may include wherein the first surface of the organic photoconductive drum is cleaned with a cloth impregnated with a dielectric non-polar liquid having a viscosity of less than 200 cSt at 40 degrees Celsius and a surface energy less than the surface energy of the first surface of the used organic photoconductive drum.

The method may include wherein the dielectric non-polar liquid is a silicone oil.

The method may include wherein the dielectric non-polar liquid is a mineral oil.

A method of recoating an organic photoconductive drum may comprise providing a used organic photoconductive drum, said used organic photoconductive drum having been previously used in an electro photographic process, said electro photographic process using dry toner, said used organic photoconductive drum having a first surface, said used organic photoconductive drum comprising a conductive substrate, a charge generation layer disposed between said conductive substrate and said first surface of said used organic photoconductive drums, a charge transport layer being disposed between said charge generation layer and said first surface; providing a means for cleaning the first surface of said organic photoconductive drum; cleaning, by the means for cleaning, the first surface of said organic photoconductive drum; providing a dielectric non-polar liquid having a viscosity less than 200 cSt at 40 degrees Celsius, said dielectric non-polar liquid having a surface energy less than a surface energy of the first surface of said used organic photoconductive drum; providing a means for applying said dielectric non-polar liquid to the first surface of the used organic photoconductive drum; and applying, by the means for applying, the dielectric non-polar liquid to the first surface of the used organic photoconductive drum to form a second surface on the used organic photoconductive drum comprising a layer of said dielectric non-polar liquid An organic photoconductive drum may comprise: an electrically conductive tube; a charge transport layer; a charge generation layer disposed between the electrically conductive tube and the charge transport layer, said charge generating layer comprising a polymer and a light sensitive material; a first surface having a first surface energy, said first surface having a first surface roughness, the charge transport layer and the charge generation layer disposed between the electrically conductive tube and the first surface; and an outer layer comprising a non-volatile liquid with a surface energy less than the first surface energy said outer layer forming the exterior surface of the organic photoconductive drum.

An organic photoconductive drum may also include wherein the non-volatile liquid comprises a dielectric non-polar liquid, said dielectric non-polar liquid having a viscosity of less than 200 cSt at 40 degrees Celsius, said outer layer having a second surface and a third surface, said second surface disposed adjacent the first surface, and said third surface disposed opposite said second surface forming the exterior of the outer layer, said second surface having a surface energy less than that of the first surface, and said second surface conforming substantially to the roughness of said first surface, said third surface having a surface roughness less than the surface roughness of said first surface roughness.

The organic photoconductive drum may include the outer layer being less than 5 microns thick.

The organic photoconductive drum may include wherein the dielectric non-polar liquid is a silicone oil.

The organic photoconductive drum may include wherein the dielectric non-polar liquid is a mineral oil.

The organic photoconductive drum may include wherein the dielectric non-polar liquid is a vegetable oil.

The organic photoconductive drum may include wherein said dielectric non-polar liquid has a viscosity between 25 and 125 cSt at 40 degrees Celsius.

The organic photoconductive drum may include wherein the dielectric non-polar liquid has a viscosity of about 50 cSt at 40 degrees Celsius.

The organic photoconductive drum may include wherein the difference in surface energy between the first surface and the second surface is greater than 8 dynes per centimeter.

A remanufactured electrophotographic cartridge may comprise a toner cartridge comprising a toner hopper section for containing toner, and a waste bin section connected to said toner hopper section, said waste bin section for containing a organic photoconductive drum; a used organic photoconductive drum comprising an electrically conductive tube, a charge transport layer, a charge generation layer disposed between the electrically conductive tube and the charge transport layer, said charge generating layer comprising a polymer and a light sensitive material, said used photoconductive drum having an first surface, said first surface having a first surface energy level, said first surface having a first surface roughness; an outer layer comprising a dielectric non-polar fluid, said dielectric non-polar fluid having a viscosity of less than 200 cSt at 40 degrees Celsius, said outer layer having a second surface and a third surface, said second surface disposed between said outer layer and said charge transport layer, and said third surface disposed opposite said second surface forming the exterior of the outer layer, said second surface having a surface energy less than a surface energy of the first surface, and said second surface conforming substantially to the roughness of said first surface, said third surface having a surface roughness less than the surface roughness of said first surface roughness.

The remanufactured toner cartridge may include wherein said toner hopper section is a previously used toner hopper.

The remanufactured toner cartridge may include wherein said waste bin section is a previously used waste bin section.

The remanufactured toner cartridge may include wherein said dielectric non-polar liquid layer is less than 5 microns thick.

The remanufactured toner cartridge may include wherein the dielectric non-polar liquid is a silicone oil.

A refurbished organic photoconductive drum comprises an outer layer comprising a dielectric non-polar fluid, said dielectric non-polar fluid having a viscosity of less than 200 cSt at 40 degrees Celsius, said outer layer having an exterior surface forming the exterior of the refurbished organic photoconductive drum and an interior surface disposed adjacent to a first surface of the refurbished organic photoconductive drum, said exterior surface having a surface energy less than a surface energy of the first surface, said exterior surface having a surface roughness less than a surface roughness of said first surface, said interior surface conforming substantially to said first surface, an electrically conductive tube; a charge transport layer disposed between the first surface and the electrically conductive tube; and a charge generation layer disposed between the electrically conductive tube and the charge transport layer, said charge generating layer comprising a polymer and a light sensitive material.

What is claimed is:

1. An apparatus for coating an organic photoconductive drum, said organic photoconductive drum having a first end with a drive gear and a second end with a hub, the apparatus comprising;

a base;

a drive side support attached to said base;

a drive gear rotatably connected to the drive side support, said drive gear adapted for receiving a removable drive gear connector;

at least one removable drive gear connector having a first end adapted for connection with the drive gear, and a second end being adapted for coupling with the first end of the organic photoconductive drum;

a transmitting wheel connected to the drive gear connector for rotating the drive ear connector wherein the transmitting wheel is connected to a drive wheel by a plurality of gears with the transmitting wheel being in communication with a handle;

a hub side support attached to the base;

a pin connector rotatably connected to the hub side support, said pin connector having a spring loaded flange adapted for fitting into the second end of the organic photoconductive drum, and;

an applicator containing a coating to be applied to the organic photoconductive drum as the organic photoconductive drum is rotated by the transmitting wheel connected to the drive gear connector.

2. The apparatus of claim 1, wherein the drive wheel is attached to a handle.

3. The apparatus of claim 1, wherein the coating to be applied comprises a dielectric non-polar liquid.

4. The apparatus of claim 3, wherein the dielectric non-polar liquid has a viscosity less than about 200 cSt at 40 degrees Celsius.

5. The apparatus of claim 1, wherein the coating to be applied is a silicone oil.

6. The apparatus of claim 1, wherein the coating to be applied is a mineral oil.

7. The apparatus of claim 1, wherein the coating to be applied is a vegetable oil.

8. The apparatus of claim 1, wherein the coating to be applied comprises a dielectric non-polar liquid.

9. The apparatus of claim 1, wherein the coating is transferred from the applicator onto the surface of the drum through direct contact of the applicator with the surface of the drum.

10. An apparatus comprising;

a base;

a drive side support attached to said base;

a drive gear rotatably connected to the first base drive side support, said drive gear adapted for receiving a removable drive gear connector;

at least one removable drive gear connector having a first end adapted for connection with the drive hub gear, and a second end being adapted for coupling with a drive gear of an organic photoconductive drum;

a transmitting wheel connected to the drive gear connector for rotating the drive gear connector, wherein the transmitting wheel is connected to a drive wheel by a plurality of gears with the transmitting wheel;

a hub side support attached to the base; and a pin connector rotatably connected to the hub side support, said pin connector having a spring loaded flange adapted for fitting into a hub of the organic photoconductive drum.

11. The apparatus of claim 9 further comprising an applicator containing a coating to be applied to the organic photoconductive drum through direct contact of the applicator with the surface of the drum.

12. The apparatus of claim 10 wherein the applicator is a cloth.

13. The apparatus of claim 12 wherein the applicator cloth is impregnated with 100 cSt Dow 200 silicone oil.

14. The apparatus of claim 11 wherein the applicator is a cloth.

15. The apparatus of claim 12 wherein the applicator cloth is impregnated with 100 cSt Dow 200 silicone oil.

16. The apparatus of claim 10 further comprising a handle connected to the transmitting wheel.

* * * * *